United States Patent [19]

Holtkamp

[11] Patent Number: 4,471,338

[45] Date of Patent: Sep. 11, 1984

[54] THERMAL CYCLING SWITCH

[75] Inventor: Calvin J. Holtkamp, Mansfield, Ohio

[73] Assignee: White Consolidated Industries, Inc., Cleveland, Ohio

[21] Appl. No.: 384,434

[22] Filed: Jun. 2, 1982

[51] Int. Cl.[3] ..... H01H 71/16

[52] U.S. Cl. ..... 337/64; 74/526; 74/527; 337/94; 337/58; 337/360

[58] Field of Search ..... 337/64, 94, 360, 58, 337/350; 74/526, 527; 29/522 R, 509, 622

[56] References Cited

U.S. PATENT DOCUMENTS 3,932,830 1/1976 Holtkamp ..... 337/64

*Primary Examiner*—Harold Broome

*Attorney, Agent, or Firm*—Pearne, Gordon, Sessions, McCoy, Granger & Tilberry

[57] ABSTRACT

A push-to-turn thermal cycling switch for regulating the wattage of a resistance type surface heating unit of a domestic cooking range of the electric type is disclosed. The duty cycle of the heating unit, and thus its heat output is regulated by the switch cycling on and off in accordance with movement of a switch-contained bimetallic element heated by current flowing to the heating unit via the switch. The switch cycling is determined by the position of a disc cam member carried on an axially shiftable, user-rotatable shaft having a detent means for rotatably locking the shaft at an "off" position. The shaft is formed in a single step die-casting operation. A latch secured disc cam retainer facilitates machine assembly of the switch components.

14 Claims, 10 Drawing Figures

68
30
15
78
70
11
PRIOR ART

THERMAL CYCLING SWITCH

BACKGROUND OF THE INVENTION

The invention relates in general to electric switches of the mechanical type, and more particularly to a low cost, infinitely-variable, thermal cycling switch control for regulating the the heat output or wattage of a resistance type surface heating unit of a domestic electric cooking range.

A typical domestic cooking range of the electric type includes a horizontal cooking platform providing four surface heating units upon which cooking utensils, such as pots and pans, are placed for heating. Associated with each unit is a separate infinitely-variable control that maintains its associated surface heating unit at a wattage output determined by the position of a user-rotatable knob of the control. Such wattage output maintenance is effected by cycling the resistance type heating unit on and off at a predetermined rate, the control including a self-heated bimetallic switch element to automatically cause such thermal cycling. Movement of the thermal cycling switch control knob mechanically biases the bimetallic element by means of a disc cam to vary the percentage on time of the controlled heating unit to produce an average power consumption corresponding to the desired wattage.

Typically, four thermal cycling switch controls are mounted on the back of a vertically extending control panel provided across the rear edge of the horizontal cooking platform supporting the surface heating units. Rotatable shafts of the control units extend through the control panel. The user-accessible knobs are mounted on the distal ends of such shafts. Rotation of each knob sets the wattage (heat output)of its controlled heating unit at a point within the range of a no heat "off" condition to a high wattage (heat output) "on" condition. Rotational detent is typically provided at the "high" wattage (heat output) position to generate tactile feedback for the range user.

For purposes of safety, such controls also include a locking detent at the "off" position of the control to preclude the inadvertent turning on of its associated heating unit. Unlocking of the detent is provided by pushing in on the control knob, to axially shift the control shaft against the force of a biasing spring, wherein turning of the knob to electrically energize the associated heating unit is then possible.

Such push-to-turn thermal cycling switches or surface heating unit wattage controls are well known in the art, as represented by U.S. Pat. No. 3,932,830, assigned to the assignee of the present invention and incorporated by reference herein in its entirety. The locking "off" position detent means illustrated in the incorporated '830 patent includes a notched, washerlike member fixed to the axially shiftable spring-biased control shaft that engages with a locking tab provided by a switch cover. Accepted industry standards require that the locking "off" position detent means, such as the type illustrated in the '830 patent, withstand at least 30 in/lbs of torque and provide at least a 6000 cycle rotational wear life.

The push-to-turn control of the type illustrated by the '830 patent includes a helical compression spring for axially biasing the control shaft against the switch cover to ensure detent locking at the "off" position. Such a spring is placed under compression during assembly of the switch. Proper positioning of associated switch components must be maintained against forces generated by the spring undergoing compression during such assembly.

SUMMARY OF THE INVENTION

The invention provides a lower cost thermal cycling switch of the type illustrated by the earlier-noted U.S. Pat. No. 3,932,830, by reducing component parts cost and by simplifying switch assembly techniques, while still providing a thermal cycling switch which fulfills the criteria noted above.

In accordance with one aspect of the present invention, an electrical switch includes a housing containing and supporting fixed and movable switching elements. A disc cam contained in and rotatably supported by the housing engages with one or more of the switching elements. A non-machined metal control shaft rotates the cam, a detent member of a material harder than the metal of the shaft being fixed in position on the shaft. A detent engaging means is fixed in position relative to the housing and lockably engages the detent member mounted on the shaft when the shaft is at a predetermined rotational position.

Preferably, the non-machined shaft is die-cast to final dimensions using a low cost zinc alloy. A hardened steel washer is fixed on the softer metal shaft and constitutes the detent member engageable with a hardened steel tab provided by a switch cover. Such a configuration provides a lockable detent means having the necessary strength characteristics and long cycle life while permitting the use of a low cost, non-machined die-cast control shaft.

In accordance with another aspect of the invention, a boxlike housing containing and supporting fixed and movable switching elements includes at least one bimetallic switching element. The housing has a base wall and plurality of side walls wherein the housing has an open end. A disc cam contained within the housing, and rotatably supported by a portion of the base wall, is engageable with one or more movable switching elements. A control shaft, received by a bore in the disc cam, rotationally drives the disc cam. A disc cam retainer, including a central aperture through which a portion of the control shaft extends, is lockably received in the open end of the housing. The retainer maintains the position of the disc cam on the supporting portion of the base wall during assembly operations. A cover closes the open end of the housing. Use of the lockable retainer eliminates the need for a hold-down clip used in the prior art to lock the control shaft (and thus the cam) in position during assembly operations. By eliminating the need for a hold-down clip, a machined hold-down clip retaining groove in an exposed end of the prior art control shaft is no longer necessary, thus allowing the use of an investment cast nonmachined control shaft.

In accordance with a further aspect of the present invention, a low cost thermal switch assembly process includes the step of providing a boxlike housing containing and supporting fixed and movable switching elements, including at least one bimetallic switching element, the housing having a base wall and a plurality of side walls wherein the housing has an open end. In a further step, a rotatable disc cam is inserted into the housing and is positioned on a support projection provided by the base wall of the housing, the cam engaging one or more movable switching elements. A disc cam retainer is placed in position at the open end of the housing, the retainer lockably engaging the side walls of the housing wherein the retainer engages the disc cam to maintain it in position on the support projection during subsequent assembly operations. Such an assembly technique eliminates the need for hold-down clip attachment and detachment assembly steps as previously used in the prior art in a manner to be subsequently described and illustrated.

BRIEF DESCRIPTION OF THE DRAWINGS

A fuller understanding of the invention may be had by referring to the following description and claims taken in conjunction with the accompanying drawings, wherein:

DETAILED DESCRIPTION OF THE PREFERRED EMBODIMENTS

Figure 1:
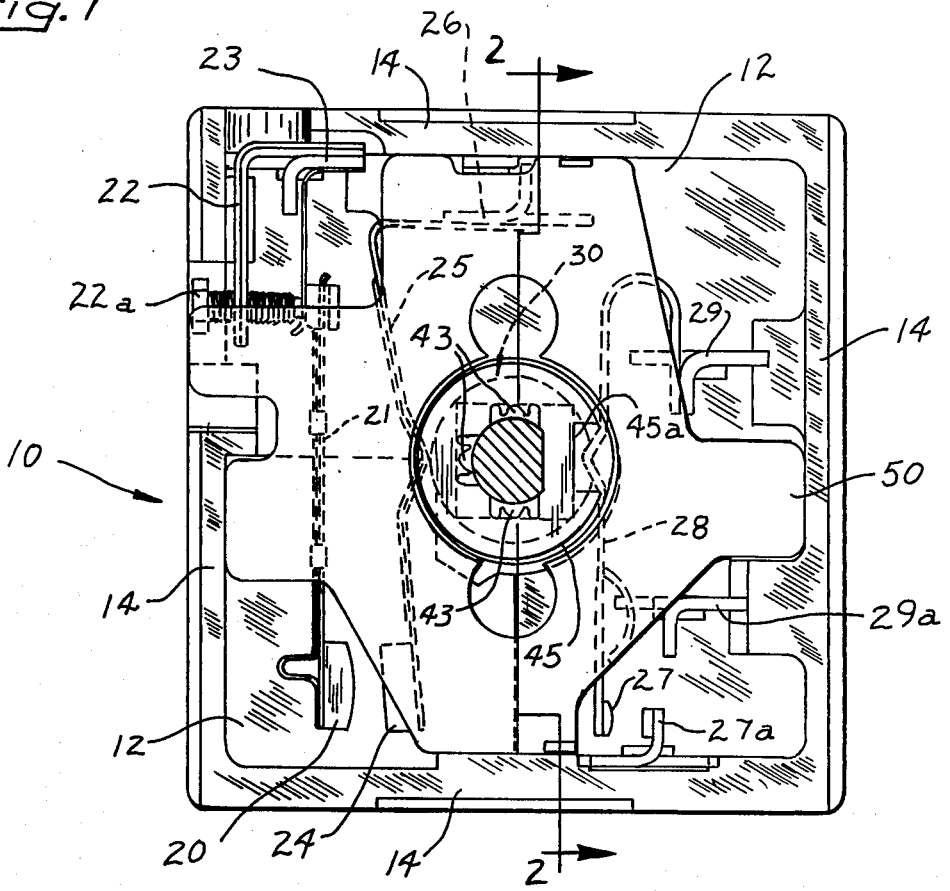
FIG. 1 is a plan view of a thermal cycling switch in accordance with the present invention without a switch cover.
Figure 2:
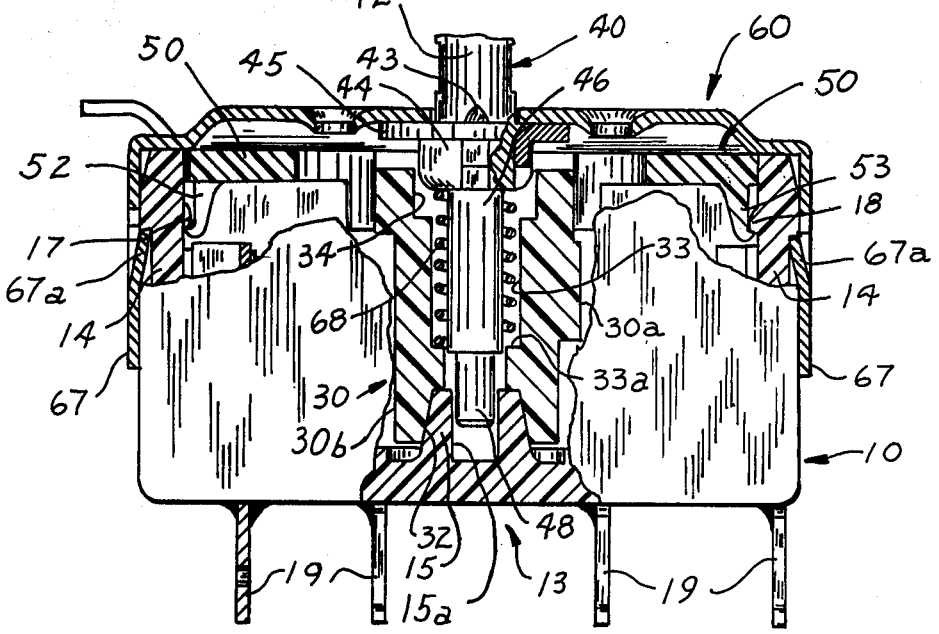
FIG. 2 is a partial cross section, elevational view of the switch illustrated in FIG. 1, taken along line 2—2 of FIG. 1 including in cross section a switch cover.
Figure 3:
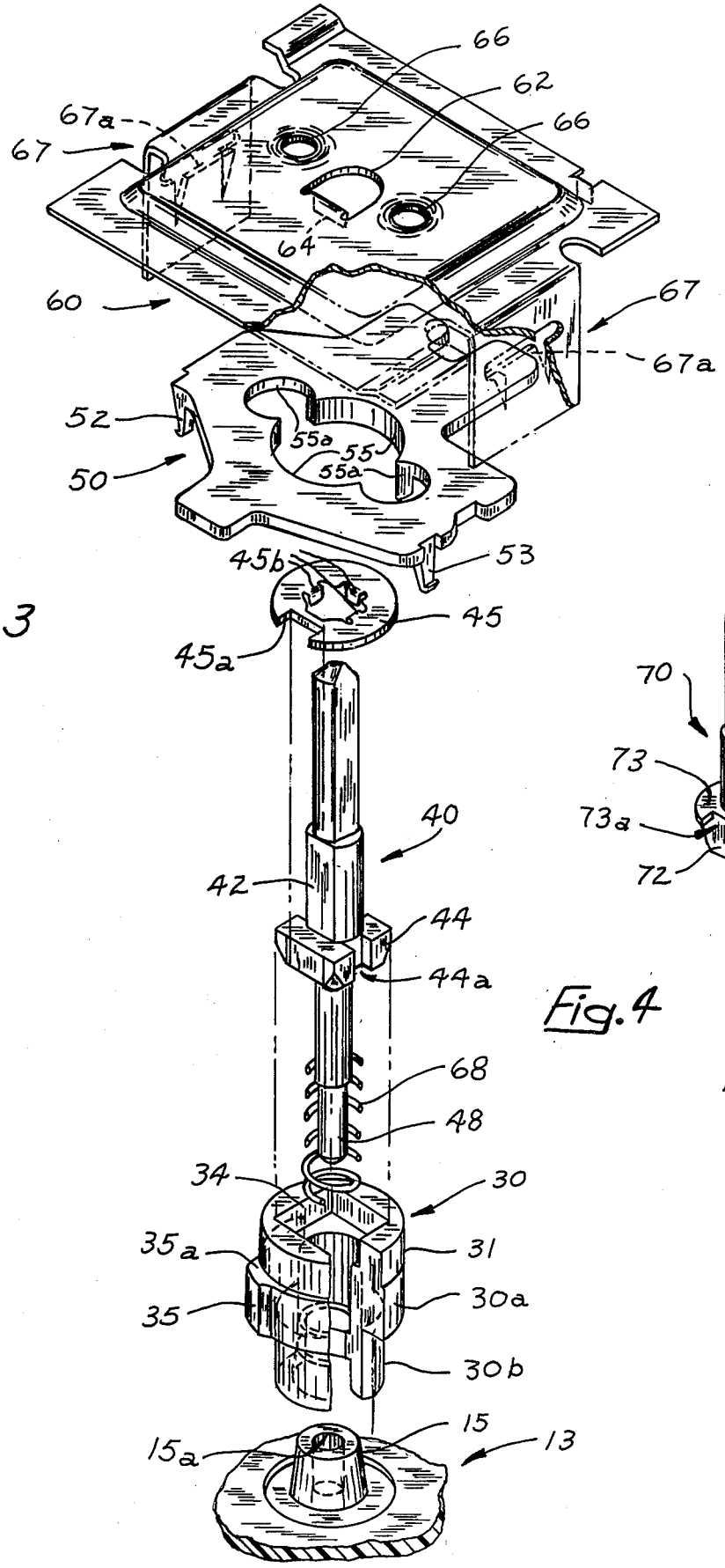
FIG. 3 is an exploded, perspective view of some major components constituting the thermal cycling switch of the present invention, including a non-machined die-cast control shaft.

FIGS. 1 through 3 illustrate a low-cost, thermal cycling switch in accordance with the present invention, such switch being an improved version of the type of switch illustrated in earlier incorporated U.S. Pat. No. 3,932,830.

The switch of FIGS. 1–3 includes a boxlike housing 10 preferably formed of injection-molded plastic material having suitable electrical insulation properties. The housing 10 includes a bottom or base wall 12 and a plurality of side walls, such as the four side walls 14 illustrated most clearly in FIG. 1. The base wall 12 and the side walls 14 define the boxlike housing 10 having an open end through which housing-contained parts of the switch are inserted during assembly.

Contained within and supported by the housing 10 are fixed and movable switching elements typically formed of electrically conductive copper-based metal, the exact details and functioning of such elements being most clearly illustrated and explained in U.S. Pat. No. 3,634,802, assigned to the assignee of the present invention, the entirety of which is incorporated herein by reference. With particular reference to FIG. 1, such elements include a thermal cycling contact 20 carried on the movable distal end of a temperature-deflectable main bimetal assembly switching element 21 of the self-heating cycling type. The supported end of the bimetal element 21 is mounted to a fixed terminal 23 which also supports one end of an ambient temperature compensation bimetal element 22 carrying at its distal end an ambient temperature calibration screw 22*a* having an end biased against the switching element 21. The bimetal switching element 21, which carries the cycling contact 20, includes a heating means which will cause the cycling contact to automatically engage and disengage (when the switch is "on") with an adjusted contact 24 fixed to the distal end of a cam-adjusted spring arm 25 having its supported end mounted to another fixed terminal 26. The adjusted contact 24 moves back and forth (from the right to the left as viewed in FIG. 1) relative to the cycling contact 20 in accordance with the position of the central portion of the arm 25 functioning as a cam follower riding on a disc cam 30, to be subsequently described in more detail.

The fixed and movable switching elements contained within and supported by the housing 10 also include a pilot light and main line contact 27 engageable with a fixed contact 27*a*, the pilot light and main line contact 27 being carried at the distal end of another spring arm 28 having its supported end mounted to a fixed terminal 29. Another fixed terminal 29*a* also electrically engages and disengages from a portion of the spring arm 28. The spring arm 28 has a central portion functioning as a cam follower riding on the cam surface of the disc cam 30. External terminal portions 19 (see FIG. 2) receive wiring for electrically connecting each switching element in circuit with a controlled resistance type heating unit, a pilot light, and the power source. As noted earlier, precise structures and functions of the switching elements noted above are known in the art, as illustrated by the earlier incorporated U.S. Pat. No. 3,634,802, and therefore such elements will not be referred to in further detail.

With particular reference to FIGS. 2 and 3, the disc cam 30 is rotatably driven by an elongated control shaft 40. The shaft 40 includes an external knob carrying distal end 42. Underlying the end 42, as viewed in FIG. 2, is a radially extending, squared cam drive portion 44 supporting at its upper radial surface a detent member in the form of a notched hardened steel washer 45 (see FIG. 3). The washer 45 is axially fixed in position on the shaft 40 by peened-over portions 43 (see FIG. 1) of the shaft 40 engaging the washer 45, thereby locking it against the upper surface of the squared cam drive portion 44 of the shaft, the inner, noncircular peripheral edge of the washer 45 abutting and being adjacent to a corresponding non-circular axial portion of the shaft 40. As shown most clearly in FIG. 3, the washer 45 includes at its outer peripheral edge a detent functioning notch 45*a*, the inner peripheral edge of the washer 45 providing a plurality of tangs 45*b* (see FIG. 3) that slide into a like plurality of shaft grooves 44*a* provided at the outer faces of the squared cam drive portion 44. The washer 45 rotationally solidly locks in position on the shaft 40, since the tangs 45*b* and the associated grooves 44*a* lie along lines parallel to the axis of rotation of the shaft 40. Also, the non-circular center aperture of the washer 45 cannot rotate on the corresponding non-circular axial portion of the shaft 40.

As further illustrated in FIG. 2, the shaft, in addition to the external control knob end 42 and the square cam drive portion 44 supporting the washer 45, includes a central spring guide portion 46 and a journaled end portion 48 of slightly reduced diameter. The central spring guide portion 46 of the shaft 40 extends within an elongated, helical compression spring 68 which serves in a known manner to bias the shaft 40 so as to force it upwardly as viewed in FIG. 2 against the underside of a snap-on cover 60, preferably made of hardened spring steel material.

The squared cam drive portion 44, the central spring guide portion 46, and the journaled portion 48 of the shaft 40 are positioned, with the spring 68, in a through bore of the disc cam 30, also preferably formed of injection-molded plastic material. The through bore of the disc cam 30 includes a square drive receiving socket defined by a four-sided wall 34 of a diameter greater than a spring-retaining portion defined by a circular wall 33. At the lower end of the cam 30 a tapered, cone-shaped bushing support wall 32 constituting the lower end of the through bore through the disc cam 30, the tapered bushing support wall 32 rotationally rides on and is supported by a non-apertured or imperforate base wall portion 13 in the illustrated form of the apex of a frustoconical support projection 15, including a blind bore defined by a circular wall 15*a*. The blind bore extends along the axis of rotation of the shaft 40 and is coaxially aligned with the through bore of the disc cam 30 so as to receive and rotatably support the journaled end 48 of the shaft 40.

As illustrated in FIGS. 2 and 3, the disc cam 30 includes a first cam surface 30*a*, which is engageable with the central cam follower portion of the spring arm 25, as illustrated in FIG. 1. The disc cam 30 also includes a second cam surface 30*b* (FIG. 3) engageable with the spring arm 28 (FIG. 1). Such cam surfaces 30*a*, 30*b* may include a plurality of indentations and raised portions constituting detents to tactilely feed back to a user an indication of rotational position of the control shaft 40, such detents being well known in the art.

The thermal cycling switch illustrated in FIGS. 1–3 is known in general as a push-to-turn control. In operating the control, the user must grasp the control knob (not shown) mounted on the external control knob end 42 of the shaft 40 and push it inwardly (downwardly as shown in FIG. 2) to disengage the detent member in the form of the notched washer 45 (FIG. 3) from a detent engaging means in the preferred form of a bent, hardened steel tab portion 64 (FIG. 3) provided by the cover 60.

As shown most clearly in FIG. 3, the bent tab portion 64 is located along a flat side of an edge 62 defining a central aperture in the cover 60 through which the external control knob end 42 of the shaft 40 extends.

To maintain the proper position of the rotatable disc cam 30, a platelike disc cam retainer 50, also preferably formed of injection-molded plastic, snaps into the open end of the housing 10 and is retained therein by a pair of resilient, pawl-like latch members 52, 53, which function as fingerlike catches engageable with undercut, keeperlike projections 17, 18 located on the inside of opposed sidewalls 14 (see FIG. 2). As shown most clearly in FIG. 3, a central aperture defining, two-section, circular wall 55 acts as a bearing surface to engage in sliding fashion a circular bearing portion 31 of the cam 30. The first cam surface 30*a*, engageable with the spring arm 25 (see FIG. 1), includes on its surface a raised high temperature point 35 which has a cam hold-down shoulder or flat 35*a* that lies immediately under the underside edge of the wall 55. Thus, the retainer 50, locked in position at the open end of the housing 10, serves, during switch assembly, to rotationally guide and axially maintain the position of the cam 30 that is supported on the frustoconical projection 15 provided by the base wall portion 13 of the housing 10.

As seen clearly in FIG. 2, a downward force on the shaft 40 against the biasing spring 68 will disengage the detent functioning notch 45*a* (FIG. 3) of the washer 45 from the tab 64 (FIG. 3) to permit rotation of the shaft 40, such rotation being effected by engagement of the square cam drive portion 44 of the shaft 40 that is inserted into and received by the square drive receiving socket defined by four-sided wall 34 of the disc cam 30. In pushing the control shaft downwardly, as shown in FIG. 2, the compression spring 68 will be further compressed and the journaled portion 48 of the shaft 40 will slide further down into the blind bore defined by wall 15*a*, the spring 68 being held between a spring supporting shoulder 33*a* of the disc cam 30 and the underside of the squared cam drive portion 44. When not at an "off" position, the bottom edge of the tab 64 (FIG. 3) rides on top of the non-notched washer portion to maintain the shaft at a pushed-in "on" position. When the shaft is turned to an "off" position, the tab 64 (FIG. 3) will snap into the detent notch 45*a* (FIG. 3) under force of the biasing spring 68.

As shown in FIG. 3, the cover 60 against which the washer 45 bears as a result of the biasing force of the compression spring 68 is held in position on the housing 10 (FIG. 1) by a pair of snap-type housing engaging ears or tangs 67 that include resilient locking tabs 67*a* (also see FIG. 2) so as to snap into undercut portions on opposite sides of the housing 10 (FIG. 1), wherein the cover 60 is lockably held in position. Appropriate sheet metal screw receiving apertures 66 are used for mounting the cycling switch on a control panel, clearance apertures being provided in the disc cam retainer 50, as defined by opposed wall portions 55*a*.

In accordance with the present invention, a significant cost savings over prior art switches is provided by utilizing a zinc alloy material or similar non-ferrous material to die cast to final dimensions the shaft 40 illustrated in FIGS. 1 through 3. As noted earlier, accepted standards in the domestic appliance industry require that the detent means provided by the washer 45 and the locking tab 64 of the cover 60 be able to withstand at least 30 in/lbs of torque and further have a rotational wear life of at least 6000 cycles. By utilizing a hardened steel washer 45 and a hardened spring steel cover 60, which provides the tab 64, such strength and wear requirements can be met. The die cast shaft 40, formed of a softer material than the washer 45 functioning as the detent means, is much less costly to produce than the prior art shaft as illustrated in FIG. 4.

The prior art shaft 70 is composed of steel that is cold-formed to the rough dimensions of the shaft 70. Shaft 70 includes an integral detent flange portion 73 that has a notched section 73*a* functioning in a manner identical to the notch 45*a* of the embodiment of the invention illustrated in FIGS. 1–3. For purposes to be subsequently illustrated, such prior art control shaft 70 includes at its lower end a machined breakaway portion 74 of reduced diameter and a hold-down clip receiving groove 76. The portion 74 and the groove 76 are machined into the lower end of the shaft 70. The shaft also includes a surface machined control knob engaging flat 71 and a surface machined detent engaging face 72, such surface machining being necessary to provide the required final dimensions so as to meet tolerances ensuring proper operation of the switch. While the prior art steel control shaft 70, which included the integral detent flange 73, was able to meet the "off" position detent strength requirements, elements 71, 72, 74, and 76 had to be separately machined by metal cutting or grinding operations, which added considerably to the cost of producing a switch of the type illustrated.

Figure 4:
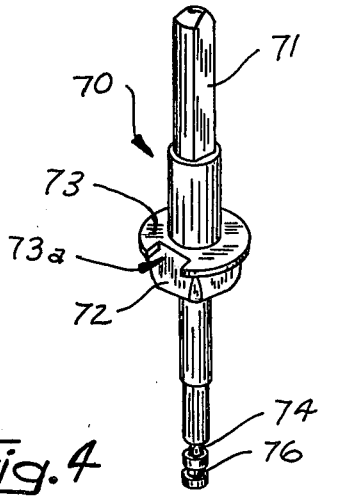
Fig. 4 PRIOR ART
FIG. 4 is a perspective view of a prior art machined control shaft formed of steel, such shaft being higher in cost than the non-machined shaft illustrated most clearly in FIG. 3.

Thus, it can be seen that the improved multipart die cast control shaft 40 of the invention, while meeting the stringent strength requirements for the "off" position detent means constituted in part by steel washer 45, does not require any costly machining operations, as was the case with the prior art control shaft 70 illustrated in FIG. 4.

Figures 5A, 5B, 5C, 6A, 6B, 6C:
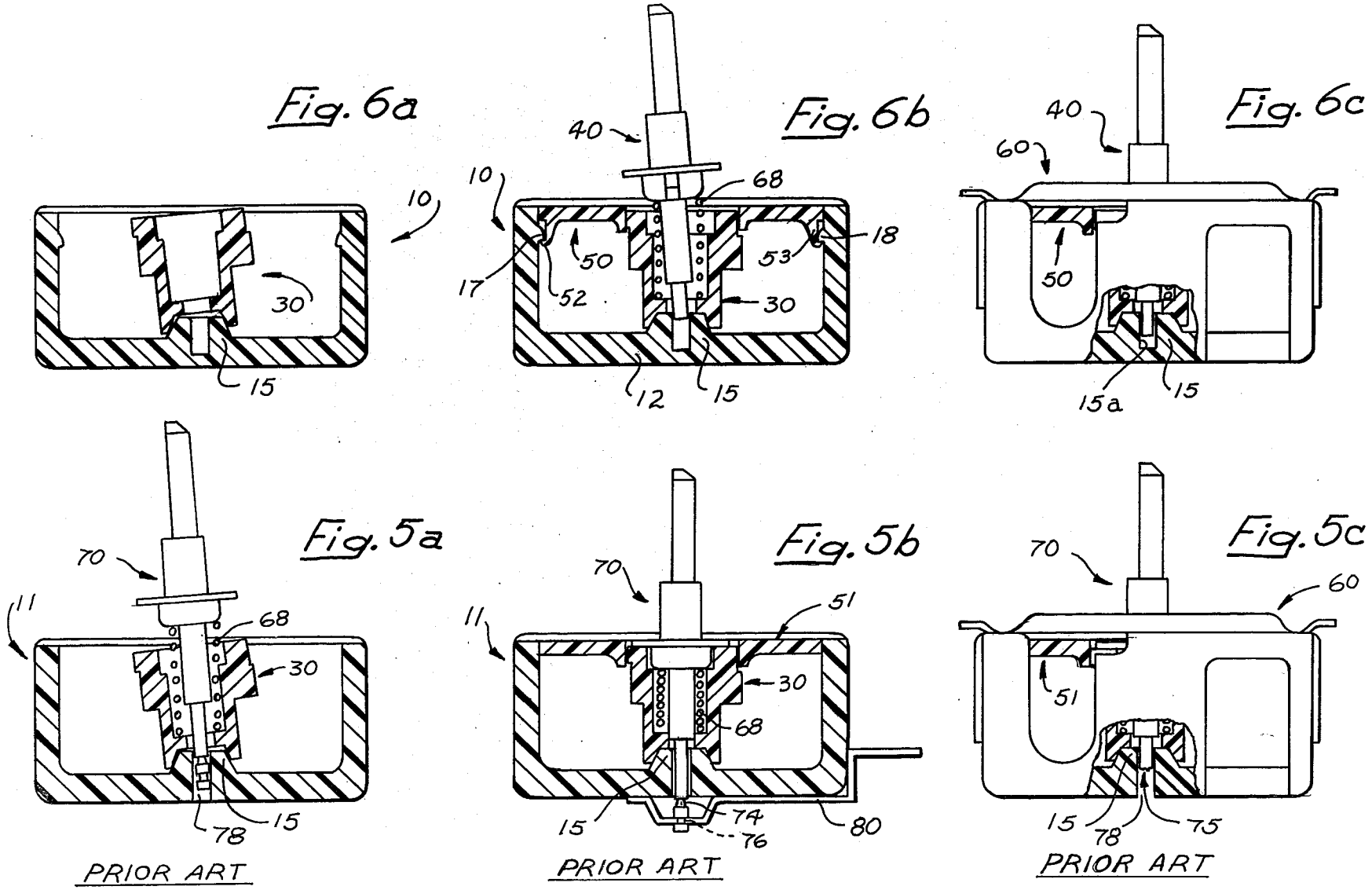
PRIOR ART Fig. 5b
PRIOR ART Fig. 5a
FIGS. 5*a*–5*c* illustrate prior art thermal cycling switch assembly steps.
FIGS. 6*a*–6*c* illustrate the thermal cycling switch assembly steps in accordance with the present invention in contrast to those illustrated in FIGS. 5*a*–5*c*.

A further aspect of the present invention can be appreciated by reference to FIGS. 5*a* through 5*c*, which illustrate prior art assembly techniques of a thermal cycling switch incorporating the prior art shaft 70 discussed with regard to FIG. 4.

In a first step as illustrated in FIG. 5*a*, the disc cam 30 is placed in position on the support portion 15 of a prior art casing 11. The portion 15 includes a centrally disposed through bore 78 that permits the lower end of the shaft 70 to extend out of the housing 11 through its bottom wall or base wall. After the disc cam was loosely placed on the support projection 15, the shaft 70 and the biasing compression-type helical spring 68 were placed in the bore of the disc cam 30.

As shown in FIG. 5*b*, the shaft 70 was then pushed down wherein its lower end extended outwardly of the housing. A hold-down clip 80 was then slipped onto the lower end of the shaft 70 and locked into the hold-down clip receiving groove 76 to hold in compression the spring 68 and hold in engagement the square drive portion of the shaft 70 with the disc cam 30. A prior art cam retainer 51 rests loosely in position at the open end of the housing 11. The spring steel cover 60 is then machine-assembled onto the subassembly of FIG. 5*b*, such machine assembly occurring while the disc cam 30, the spring 68, and the shaft 70 are held in proper position by the hold-down clip 80.

In a final step, the hold-down clip 80 is removed and the lower end of the shaft is broken off at the reduced breakaway portion 74 to ensure that no portion of the lower end of the shaft 70 will be exposed beyond the lower end of the bore 78 in the base wall of the housing 11 when the shaft is pushed in to turn the switch on. This is desirable to preclude an extended and exposed shaft end that could be interfered with so as to hamper axial and rotational movement of the shaft 70. Also, should the metal shaft 40 come in contact with current carrying elements in the switch, the resultant shock hazard is minimized by breaking off the exposed end of the shaft. The fractured end 75 of the shaft 70 as illustrated in FIG. 5*c* is, however, still accessible via the bore 78 in the bottom of the casing 11, wherein dirt or other foreign matter could enter the housing 11 and/or interfere with axial movement of the shaft 70.

An improved assembly technique, which utilizes the advantages of the earlier discussed novel disc cam retainer 50, is illustrated in assembly step fashion by FIGS. 6*a* through 6*c*.

In accordance with the invention, the cam disc 30 is positioned on the support projections 15. With reference to FIG. 6*b*, the disc cam retainer 50 is snapped into the end of the housing 10, the resilient latch members 52 and 53 lockably retaining the disc cam retainer 50 in position by engagement with the slightly undercut portions 17 and 18 molded into opposed interior walls of the housing 10. Because of this configuration, i.e., the locked retainer in fixed position so as to retain the disc cam 30, there is no need for a hold-down clip 80 or a lower projecting end of the shaft 70 as earlier discussed with regard to FIG. 5*b*. This has numerous advantages in that the bottom base wall 12 of the housing 10 can be closed so that access to the interior of the switch housing 10 and the lower end of the shaft 40 is precluded, such a feature being desirable from a safety standpoint, since high electrical currents are carried by switching elements within the housing 10. Also, dirt and other types of foreign matter that could interfere with operation of the switch cannot enter the housing 10 via a base wall bore. In a further step, the control shaft 40 and the spring 68 are loosely received in the through bore of the retained disc cam 30.

With reference to FIG. 6*c*, the cover 60 is then machine-assembled onto the housing 10, the spring 68 and the shaft 40 being positioned as shown in FIG. 2 during such machine application of the cover 60. During cover attachment, the cam 30 is held in position against, for example, side thrust forces generated by spring arm elements 25, 28, by the locked retainer 50 as the spring 68 is compressed and the bottom end of the shaft 40 is fully inserted into the blind bore of the support projection 15 as illustrated.

From the foregoing discussion, it is evident that numerous advantages of the invention lead to a low-cost thermal cycling switch. The non-machined, die-cast shaft 40 can be manufactured at considerably lower cost than the prior art shaft illustrated in FIG. 4. Further, such shaft 40, when combined with the hardened spring steel washer 45, ensures meeting the stringent strength requirements of an "off" position detent means. Further, the use of the latches 52, 53 on the retainer 50 precludes the need for the holddown clip 80 and modifications to the end of the control shaft, such modifications being illustrated in FIG. 4 as breakaway section 74 and clip receiving groove 76. Use of the lockable retainer 50 also precludes the need for a central aperture in the lower base wall of the housing, so that exposure to interior portions of the switch is eliminated. Finally, as illustrated in FIGS. 6*a* through 6*c* as contrasted with prior art FIGS. 5*a* through 5*c*, the assembly steps of the switch illustrated in FIGS. 1–3 are simplified in that there is no need to attach and detach a hold-down clip 80 (FIG. 5*b*), nor is there a need to break off the end of the prior art shaft 70 at breakaway portion 74.

The elimination of assembly steps and the reduced costs of manufacturing the die-cast shaft 40 advantageously result in a lower cost thermal cycling switch functioning in an exceptional manner from a safety and reliability standpoint.

It is recognized that other variations and modifications of the invention as described above are possible. While the invention has been shown and described with respect to a specific embodiment, this is intended for purposes of illustration rather than limitation and other variations and modifications of the specific form of the invention shown and described will be apparent to those skilled in the art, all within the intended spirit and scope of the invention. Accordingly, this patent is not to be limited to the specific embodiment shown and described, nor in any other way which is inconsistent with the extent to which the progress in the art has been advanced by this invention.

What is claimed is:

1. An electrical switch comprising:

a housing containing and supporting fixed and movable switching elements ;

a disc cam contained within the housing and being rotatably supported therein, the disc being engageable with one or more movable switching elements;

a non-machined metal control shaft for rotating the disc cam;

a detent member composed of a material harder than the metal of the shaft, the detent member being fixed in position on the shaft; and a detent engaging means fixed in position relative to the housing, the detent engaging means being lockable with the detent member mounted on the shaft when the shaft is at a predetermined rotational position.

2. A switch according to claim 1, wherein the material forming the detent engaging means is of a hardness generally equivalent to the hardness of the detent member.

3. A thermal cycling switch comprising:

a boxlike housing containing and supporting fixed and movable switching elements including at least one bimetallic switching element, the housing having a base wall and a plurality of side walls wherein the housing has an open end;

a disc cam contained within the housing and being rotatably supported by a portion of the base wall, the disc cam being engageable with one or more movable switching elements;

a non-ferrous metal control shaft received by a bore in the disc cam, the shaft being axially slidable in the bore between two positions and being biased toward one of said positions, the shaft rotatably driving the disc cam;

a detent member composed of a material harder than the metal of the shaft, the detent member being fixed in position on the shaft; and a cover closing the open end of the housing, the cover including detent engaging means lockable with the detent member when the shaft is at said one axial position to preclude rotation of the disc cam, the detent member disengaging from the detent engaging means when the shaft moves toward its other axial position.

4. A thermal cycling switch according to claim 3, wherein the shaft is die cast formed.

5. A thermal cycling switch according to claim 3, wherein the detent member is constituted by a steel washer axially fixed in position on the shaft by peened portions of the shaft lockably engaging the washer.

6. A thermal cycling switch comprising:

a boxlike housing containing and supporting fixed and movable switching elements including at least one bimetallic switching element, the housing having a base wall and a plurality of side walls wherein the housing has an open end;

a disc cam contained within the housing and being rotatably supported by a portion of the base wall, the disc cam being engageable with one or more movable switching elements;

a non-ferrous metal control shaft received by a bore in the disc cam, the shaft being axially slidable in the bore between two positions and being biased toward one of said positions, the shaft rotatably driving the disc cam;

a detent member composed of a material harder than the metal of the shaft, the detent member being fixed in position on the shaft;

a cover closing the open end of the housing, the cover including detent engaging means lockable with the detent member when the shaft is at said one axial position to preclude rotation of the disc cam, the detent member disengaging from the detent engaging means when the shaft moves toward its other axial position;

wherein the detent member is constituted by a steel washer axially fixed in position on the shaft by peened portions of the shaft lockably engaging the washer; and wherein the washer has an inner diameter edge adjacent to an axial portion of the shaft, the inner diameter edge providing a plurality of tablike projections extending parallel to the axis of rotation of the shaft, the tablike projections being received in grooved portions of the shaft to rotatably lock the washer in position on the shaft, an outer diameter edge of the washer including a notch for receiving a projection provided by the cover and constituting the detent engaging means wherein the shaft is locked against rotation when the notch engages the projection.

7. A thermal cycling switch comprising:

a boxlike housing containing and supporting fixed and movable switching elements including at least one bimetallic switching element, the housing having a base wall and a plurality of side walls wherein the housing has an open end;

a disc cam contained within the housing and being rotatably supported by a portion of the base wall, the disc cam being engageable with one or more movable switching elements;

a control shaft received by a bore in the disc cam, the shaft rotationally driving the disc cam;

a disc cam retainer including a central aperture through which a portion of the control shaft extends, the retainer being lockably received in the open end of the housing, the retainer maintaining the position of the disc cam on the supporting portion of the base wall; and a cover closing the open end of the housing.

8. A thermal cycling switch according to claim 7, wherein the housing and the retainer are integral elements formed from injection-molded plastic material, the retainer snapping into the open end of the housing and being lockably retained therein.

9. A thermal cycling switch comprising:

a boxlike housing containing and supporting fixed and movable switching elements including at least one bimetallic switching element, the housing having a base wall and a plurality of side walls wherein the housing has an open end;

a disc cam contained within the housing and being rotatably supported by a portion of the base wall, the disc cam being engageable with one or more movable switching elements;

a control shaft received by a bore in the disc cam, the shaft rotationally driving the disc cam;

a disc cam retainer including a central aperture through which a portion of the control shaft extends, the retainer being lockably received in the open end of the housing, the retainer maintaining the position of the disc cam on the supporting portion of the base wall;

a cover closing the open end of the housing;

wherein the housing and the retainer are integral elements formed from injection-molded plastic material, the retainer snapping into the open end of the housing ang being lockably retained therein; and wherein the retainer includes a plurality of resilient pawl-like latch elements that catch on projections provided by the interior surface of the switch housing side walls to lockably retain the disc cam retainer in position at the open end of the housing.

10. A thermal cycling switch comprising:

a boxlike housing containing and supporting fixed and movable switching elements including at least one bimetallic switching element, the housing having a base wall and a plurality of side walls wherein the housing has an open end;

a disc cam contained within the housing and being rotatably supported by a portion of the base wall, the disc cam being engageable with one or more movable switching elements;

an elongated control shaft received by a bore in the disc cam, the shaft being axially slidable in the bore, the shaft being axially slidable in the bore between two positions and being biased toward one of said positions, the shaft rotationally driving the disc cam;

a platelike disc cam retainer including a central aperture through which a portion of the control shaft extends, the retainer being snapped into and lockably received by the open end of the housing; and a cover closing the open end of the switch housing.

11. A thermal cycling switch according to claim 10, wherein said portion of the base wall rotatably supporting the disc cam is constituted by a frustoconical projection having its apex portion insertable into the bore of the disc cam, said disc cam bore being a through bore having a tapered end that rides on the projection, the retainer maintaining the disc cam in position on the projection against side thrust forces applied to the cam during assembly of the switch.

12. A thermal cycling switch comprising a boxlike housing containing and supporting fixed and movable switching elements including at least one bimetallic switching element, the housing having a base wall and a plurality of side walls wherein the housing has an open end;

a disc cam contained within the housing and being rotatably supported by a portion of the base wall, the disc cam being engageable with one or more movable switching elements;

an elongated control shaft received by a bore in the disc cam, the shaft being axially slidable in the bore, the shaft being axially slidable in the bore between two positions and being biased toward one of said positions, the shaft rotationally driving the disc cam;

a platelike disc cam retainer including a central aperture through which a portion of the control shaft extends, the retainer being snapped into and lockably received by the open end of the housing;

a cover closing the open end of the switch housing;

wherein said portion of the base wall rotatably supporting the disc cam is constituted by a frustoconical projection having its apex portion insertable into the bore of the disc cam, said disc cam bore being a through bore having a tapered end that rides on the projection, the retainer maintaining the disc cam in position on the projection against side thrust forces applied to the cam during assembly of the switch, and wherein the projection is imperforate and includes a blind bore axially aligned with the through bore in the disc cam when in position on the projection, an end of the control shaft being insertable through the through bore and received in the blind bore, and being axially movable therein between two positions.

13. A method of assembling of thermal cycling switch comprising the steps of:

providing a boxlike housing containing and supporting fixed and movable switching elements including at least one bimetallic switching element, the housing having a base wall and a plurality of side walls wherein the housing has an open end;

inserting a rotatable disc cam into the housing and positioning it on a support projection provided by the base wall of the housing, the cam engaging one or more movable switching elements; and placing a disc cam retainer in position at the open end of the housing, the retainer lockably engaging the side walls of the housing, the retainer engaging the disc cam to maintain it in position on the support projection during subsequent assembly operations.

14. A method of assembling a thermal cycling switch comprising the steps of:

providing a boxlike housing containing and supporting fixed and movable switching elements including at least one bimetallic switching element, the housing having a base wall and a plurality of side walls wherein the housing has an open end;

inserting a rotatable disc cam into the housing and positioning it on a frustoconical support projection provided by the base wall of the housing, the cam engaging one or more movable switching elements, said engaged elements exerting side thrust forces on the disc cam generating force components in a direction parallel to its axis of rotation;

snapping a platelike disc cam retainer in position at the open end of the housing, latch portions of the retainer lockably engaging the side walls of the housing, the retainer including a central aperture defined by edge wall portions engageable with the cam disc to maintain it in position on the support projection;

inserting via the said aperture an elongated helical compression spring into a bore in the disc cam;

inserting through the spring and via the aperture an elongated control shaft for rotatably driving the disc cam, one end of the spring bearing on the disc cam and the other end of the spring bearing on a shoulder portion of the control shaft; and snapping a cover into a locked position over the open end of the housing, the cover including an aperture through which an end of the control shaft extends, the cover engaging the control shaft to compress the spring between the shaft and the disc during the snapping of the cover into position over the open end of the housing.

* * * * *